US012338695B2

(12) United States Patent
De Mul

(10) Patent No.: US 12,338,695 B2
(45) Date of Patent: Jun. 24, 2025

(54) MOBILE LAND RIG WITH A PIVOTAL TOP DRIVE UNIT

(71) Applicant: Itrec B.V., Schiedam (NL)

(72) Inventor: Arthur Alexander De Mul, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 18/695,578

(22) PCT Filed: Sep. 26, 2022

(86) PCT No.: PCT/EP2022/076714
§ 371 (c)(1),
(2) Date: Mar. 26, 2024

(87) PCT Pub. No.: WO2023/046963
PCT Pub. Date: Mar. 30, 2023

(65) Prior Publication Data

US 2025/0122768 A1 Apr. 17, 2025

(30) Foreign Application Priority Data

Sep. 27, 2021 (NL) ..... 2029257

(51) Int. Cl.

| | |
|---|---|
| ***E21B 19/15*** | (2006.01) |
| ***E21B 3/02*** | (2006.01) |
| ***E21B 7/02*** | (2006.01) |
| ***E21B 19/06*** | (2006.01) |
| ***E21B 19/10*** | (2006.01) |

(52) U.S. Cl.
CPC ..... *E21B 19/155* (2013.01); *E21B 3/022* (2020.05); *E21B 7/023* (2013.01); *E21B 19/06* (2013.01); *E21B 19/10* (2013.01)

(58) Field of Classification Search
CPC ..... E21B 19/155; E21B 3/022; E21B 7/023; E21B 19/06; E21B 19/10
See application file for complete search history.

(56) References Cited

U.S. PATENT DOCUMENTS

| | | | |
|---|---|---|---|
| 11,035,183 | B2 | 6/2021 | Donnally et al. |
| 2016/0145954 | A1 | 5/2016 | Helms et al. |
| 2020/0040673 | A1 | 2/2020 | Donnally et al. |

FOREIGN PATENT DOCUMENTS

| | | | |
|---|---|---|---|
| WO | WO 2016/197255 | A1 | 12/2016 |
| WO | WO 2018/093259 | A1 | 5/2018 |
| WO | WO 2020/028858 | A1 | 2/2020 |

OTHER PUBLICATIONS

Dutch Search Report, issued in Priority Application No. 2029257, dated May 3, 2022.
International Search Report, issued in PCT/EP2022/076714, dated Dec. 22, 2022.
Written Opinion of the International Searching Authority, issued in PCT/EP2022/076714, dated Dec. 22, 2022.

*Primary Examiner* — Tara Schimpf
*Assistant Examiner* — Daniel T Craig
(74) *Attorney, Agent, or Firm* — Birch, Stewart, Kolasch & Birch, LLP

(57) ABSTRACT

A mobile land rig is adapted to perform drilling and/or wellbore related activities. The mobile land rig includes a drilling tower, a loader and a top drive system including a pivotal top drive unit. The top drive system is provided with an actuator assembly adapted to cause the pivot motion of the top drive unit.

12 Claims, 6 Drawing Sheets

MOBILE LAND RIG WITH A PIVOTAL TOP DRIVE UNIT

Figure 1:
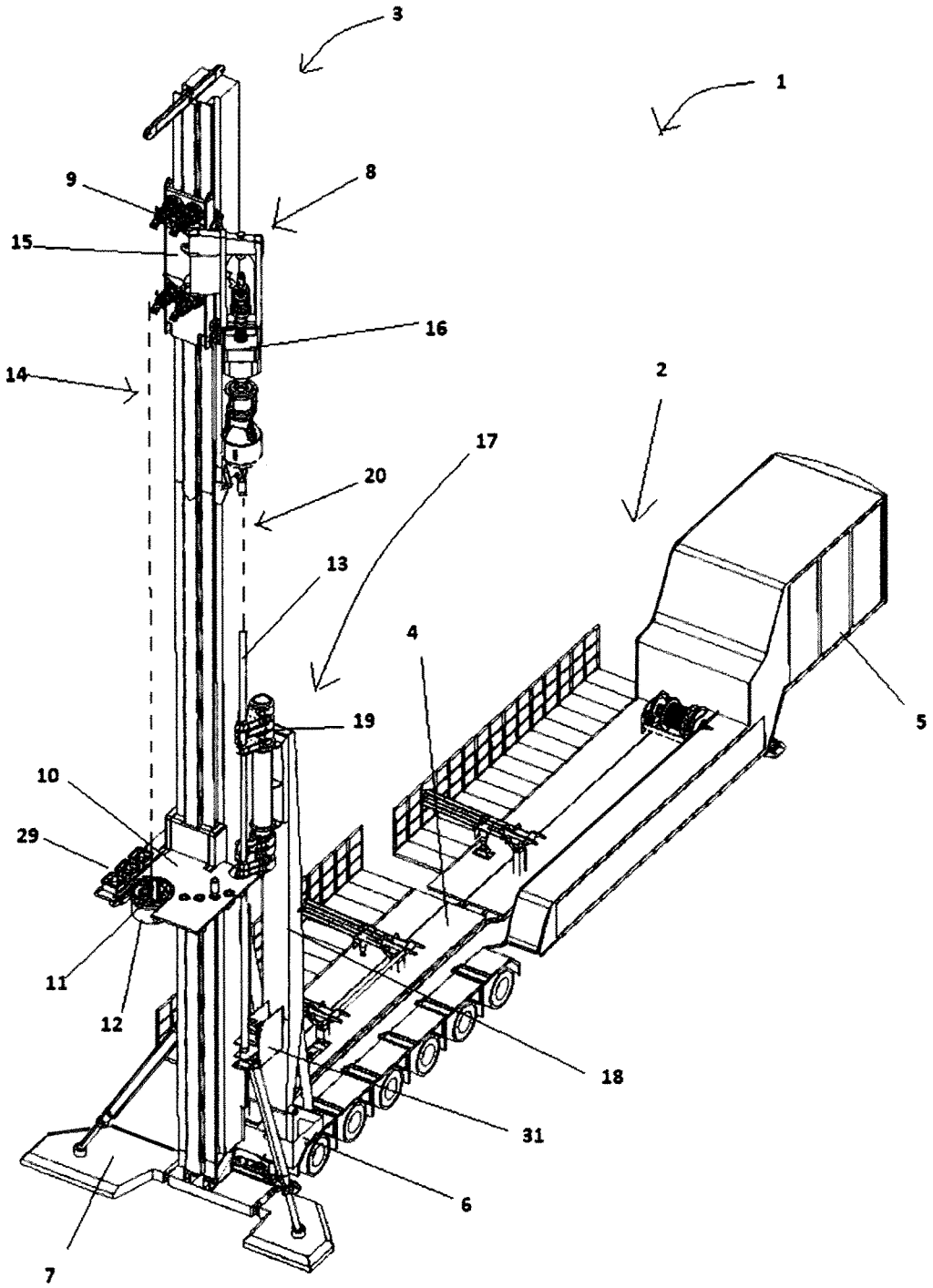

The invention relates to the field of drilling rigs. In particular, the invention is related to a mobile land rig adapted to perform drilling and/or wellbore related activities. The invention is further related to a method for performing drilling and/or other wellbore related activities wherein use is made of the mobile land rig of the invention. The mobile land rig and method of the invention may, for example, be used in mining activities and/or geothermal activities.

Mobile land rigs are used to perform wellbore drilling and wellbore related activities. For example, WO2018/093259 discloses a mobile land rig for drilling and/or servicing a well comprising a road vehicle having an elongated chassis. The land rig further comprises a derrick unit with an erectable derrick mast. The derrick unit is rotatable supported on the chassis such that it can be rotated around a vertical position.

During wellbore drilling activities drilling tubulars are provided by a pipe loader installation adapted for loading and/or unloading tubular pipes onto the mobile land rig. The loader installation is provided on a road vehicle which has to be carefully oriented relative to the mobile land rig in order to be able to perform wellbore drilling activities, reducing efficiency thereof.

The present invention aims to provide an improved mobile drilling rig and method, e.g. in view of improving efficiency of performing wellbore related activities.

The first aspect of the invention is related to a mobile land rig according to claim 1 adapted to perform drilling and/or other wellbore related activities.

The top drive unit is pivotally supported by the traveling carriage about a top drive pivot axis which extends parallel to the longitudinal axis of the drilling tower between a transfer position and a drilling position. The top drive system is provided with an actuator assembly adapted to cause said pivot motion of the top drive unit.

when the drilling tower is in the working position and the top drive unit is in the drilling position, the top drive unit is aligned with the drilling line, and the rotary torque output member is adapted to be engaged with a top end of a drilling tubulars string extending in the drilling line through the well center to impart torque to the drilling tubulars string in order to perform drilling and/or other wellbore related activities.

When the drilling tower is in the working position and the top drive unit is in the transfer position, the top drive unit is aligned with the pipe receiving line, and the top drive unit is adapted to be engaged with a top end of a drilling tubular in the pipe receiving line so as to transfer the drilling tubular from the pipe receiving line to the drilling line.

The chassis may be a chassis of a road vehicle, e.g. a trailer, e.g. a truck trailer. In an alternative, the chassis is not part of a road vehicle, but is configured to be transported on a road vehicle to a drill site, e.g. to then removed therefrom and to be placed on the ground or a foundation. The chassis may, in embodiments, be a modular chassis, which is transported to the drill site in modules and then assembled.

The chassis has a longitudinal axis extending between a front end of the chassis and a rear end of the chassis. In embodiments, the front end of the chassis may be connectable to a truck in order to transport the chassis over the road. In embodiments, the chassis comprises wheels to allow movement thereof over a road.

The top drive system comprises a traveling carriage that is vertically mobile along the drilling tower by means of a vertical motion drive. In embodiments the vertical motion drive may be a rack and pinion drive. In other embodiments the vertical motion drive may comprise trolley tracks and a draw works mechanism.

The mobile land rig further comprises a drilling tubulars handling device for supplying a drilling tubulars to a pipe receiving line. The drilling tubulars handling device may be a loader provided on the chassis, such as disclosed herein, or an upending device for preparing a drilling tubular to be upended by the top drive unit.

The top drive unit is pivotally supported by the traveling carriage about a top drive pivot axis which extends parallel to the longitudinal axis of the drilling tower between a transfer position and a drilling position. The top drive unit may further be pivotally supported by the traveling carriage about a second top drive pivot axis which extends transverse to the longitudinal axis of the drilling tower between the transfer position and the drilling position, e.g. in order to transfer the top drive unit between the transfer position and the drilling position the top drive unit is to be pivoted about both pivot axes.

The mobile land rig allows, when the drilling tower is in the working position and the top drive unit is in the drilling position, that the top drive unit is aligned with the drilling line, and the rotary torque output member is adapted to be engaged with a top end of a drilling tubulars string extending in the drilling line through the well center to impart torque to the drilling tubulars string in order to perform drilling and/or other wellbore related activities.

Additionally, the mobile land rig allows, when the drilling tower is in the working position and the top drive unit is in the transfer position, that the top drive unit is aligned with the pipe receiving line, and the top drive unit is adapted to be engaged with a top end of a drilling tubular in the pipe receiving line.

In embodiments, a drilling tubular is provided in the pipe receiving line, engaged by the top drive unit, and upended, e.g. transported from a substantially horizontal orientation to a substantially vertical orientation, by the top drive system.

The top drive unit is adapted to transfer the drilling tubular from the pipe receiving line to the drilling line, e.g. said transfer comprising first lifting the drilling tubular to a vertical orientation and height above the drill floor and then pivoting the top drive unit to the drilling position so that the drilling tubular is in the drilling line.

By providing the drilling tubulars handling device, e.g. the loader or the pipe upending device, on the same road vehicle as the drilling tower, there is no need to provide a separate vehicle for the pipe handling device. The top drive unit may pivot between being aligned with the drilling line and the gripping line. By engaging a drilling tubular with the top drive unit, the drilling tubular may be transported by the top drive unit between the drilling line and the pipe receiving line, e.g. the gripping line. In this manner drilling tubulars can be supplied or removed from the drilling line by using the pivotally top drive unit and the handling device provided on the same road vehicle as the drilling tower.

Thus it is not necessary to orient two vehicles relative to each other and wellbore related activities may be started as soon as the mobile land rig is prepared, increasing efficiency. By integrating the pipe loader on the same chassis as the drilling mast a compact design is provided and good aligning between the drilling line and the loader is assured.

By using pivot mechanisms, e.g. to pivot the top drive unit, the mobile land rig is more robust to damage, e.g. caused by dirt, than it would be if other mechanisms, e.g. linear sliding mechanisms, would be used.

In an embodiment, the tubulars handling device comprises a loader, which loader comprises:

a pivotal loader boom; and a gripper for gripping a tubular, e.g. a drill pipe, extending in a gripping line, which gripper is supported by the loader boom, wherein the loader boom is pivotally connected to the chassis preferably at the rear end, about a loader pivot axis between a tubular receiving position and a vertical tubular hand off position, wherein the loader pivot axis is transverse to the longitudinal axis of the chassis, wherein the loader is adapted to grip and move a drilling tubular when the loader boom pivots between the receiving position and the hand off position, wherein the gripping line coincides with the pipe receiving line when the loader is in the hand off position, wherein, preferably, when the drilling tower is in the working position and the loader boom is in the hand off position, the top drive pivot axis defines a center of an imaginary circle comprising the drilling line and the pipe receiving line.

The mobile land rig of this embodiment comprises a loader which comprises a pivotal loader boom and a gripper for gripping a tubular, e.g. a drill pipe, extending in a gripping line. The gripping line is preferably parallel to the drilling line when the loader is the hand off position.

The loader boom is pivotally connected to the chassis, preferably at the rear end, about a loader pivot axis between a tubular receiving position and a vertical tubular hand off position, wherein the loader pivot axis transverse to the longitudinal axis of the chassis. Preferably the loader pivot axis and the tower pivot axis are parallel, e.g. the tower pivot axis and the loader pivot axis may be aligned so that the loader and the drilling tower pivot about the same pivot axis.

Preferably, when the drilling tower is in the working position and the loader boom is in the hand off position, the top drive pivot axis defines a center of an imaginary circle comprising the drilling line and the gripping line. It may be possible that the top drive unit is, e.g. slightly, moveable in a radial direction of the imaginary circle, in that case the drilling line and the pipe receiving line do not have to lie exactly on the imaginary circle.

In order for the top drive unit to be able to engage a drilling tubular supported by the loader, the pipe receiving line is preferably provided centered on a known location relative to the drilling tower. In known systems the position of the gripped tubular may vary due to various effects, e.g. due to the gripper jaws closing at varying speeds.

In order to increase the stiffness of the gripper and the precision of the location of the gripping line, in embodiments, the gripper comprises:

a main shaft provided with at least one jaw set, e.g. two spaced apart jaw sets, wherein the jaw set comprises:

a first jaw pivotally mounted via a jaw base thereof on the main shaft;

a second jaw pivotally mounted via a jaw base thereof on the main shaft adjacent to the first jaw;

a jaw set actuator mechanism that is adapted to cause synchronized pivotal motion in opposed pivotal directions of the first and second jaws about the main shaft;

which jaw set actuator mechanism comprises a gear wheel that is provided on a gear wheel axle which is mounted radially to the main shaft, which gear wheel meshes with a toothing that is provided on the first jaw base and with a toothing that is provided on the second jaw base, providing synchronized pivotal motion of the first jaw and the second jaw, and wherein the jaw set actuator mechanism comprises a jaws actuator that is provided between the first jaw and the second jaw and connected to the first jaw at a point away from the jaw base of the first jaw and to the second jaw at a point away from the jaw base of the second jaw, so as to be able to exert a relative pulling or pushing force between the first jaw and the second jaw.

The gear provided on gear wheel axle provides that the first jaw and the second jaw open at the same speed by connecting the pivot motion of the two jaws. Thus providing a synchronized pivotal motion of the first jaw and the second jaw and a stable location of the pipe receiving line relative to the loader. By providing the gripper actuator between the first jaw and the second jaw, at points away from the jaw base, the gear does not carry the gripping force exerted by the gripping actuator.

Preferably, the gripper comprises a main shaft with at least two spaced apart jaw sets, each comprising a first and second jaw, a jaw set actuator mechanism and a gear provided on a separate gear wheel axle. This allows for more stable gripping of the tubulars by the gripper.

In embodiments the jaw set further comprises:

a third jaw pivotally mounted via a jaw base thereof on the main shaft adjacent to the second jaw and opposite to the first jaw;

a second jaws actuator provided between the second jaw and the third jaw and connected to the second jaw at a point away from the jaw base of the second jaw and to the third jaw at a point away from the jaw base of the third jaw, so as to be able to exert a relative pulling or pushing force between the second jaw and the third jaw.

Alternatively the third jaw may be fixed to the first jaw, e.g. by a bridge through the mast, so that the third jaw moves synchronously with the first jaw.

In embodiments, the gripper comprises:

a main shaft provided with at least one jaw set, e.g. two spaced apart jaw sets, wherein the main shaft is journaled about a main axis thereof about a gripper base that is mounted to the loader boom to allow for pivoting of the gripper, wherein an actuator is provided for rotating the main shaft about the main axis.

For example, the main shaft is rotatable to bring the at least one jaw set into a horizontal transfer position that allows for horizontal transfer of a drilling tubular between a tubulars storage wherein drilling tubulars are stored and the jaw set when the loader boom is in the receiving position, e.g. into two opposed positions allowing for horizontal transfer into two opposite horizontal directions when the loader boom is in the receiving position, e.g. for transfer out of and to a tubulars storage on a further road vehicle parked adjacent the chassis on which the loader boom is mounted.

By journaling the main shaft about a main axis the gripper may be pivoted relative to the loader boom. By pivoting the gripper, the gripper may be oriented in a more advantageous position, e.g. for receiving tubulars from a tubular storage. For example, the main shaft may be rotatable to bring the at least one jaw set into a horizontal transfer position that allows a tubular to be provided into the gripper in a horizontal direction. In embodiments the gripper may be oriented in various positions, e.g. into two opposed positions allowing for horizontal transfer of tubulars to and from the gripper along opposite directions.

In embodiments, the motion drive comprises a rack and pinion mechanism, wherein a rack track is provided on the drilling tower and a pinion drive is provided on the traveling carriage. A rack and pinion mechanism may be advantageous to allow precise control of the motion of the traveling carriage and eliminates the need for providing winches and the like on the road vehicle, saving space.

In a further embodiment, the drill floor is supported by the rack track of the drilling tower, e.g. allowing adjustment of the drill floor parallel to the longitudinal axis of the drilling tower. This allows for adjusting the distance between the drill floor and, e.g., the wellbore, thus allowing to adjust for varying space requirements. For example, a BOP (Blow Out Preventer) device may be provided between the drill floor and the wellbore, e.g. mounted on a wellhead, and depending on the size of the BOP device the height of the drill floor may be adjusted.

In embodiments, the mobile land rig further comprises a tubulars connection makeup and breaking device that is arranged near the well center, e.g. on the drill floor or mounted, e.g. in mobile manner, to the drilling tower above the drill floor.

In embodiments, the mobile land rig further comprises one or more slidable storage carriers, e.g. supported by the drill floor, for storing drilling equipment, e.g. configured for storing one or more drill bits. The slidable storage carrier is slidable, e.g. horizontally, e.g. over the top face of the drill floor. The top drive unit is pivotal into drilling equipment handling position allowing to connect a drilling tubular engaged with the top drive unit to be connected to the drilling equipment stored in the storage carrier. Preferably, in each position a different storage slot of a storage carrier lies on the imaginary circle defined by rotary torque output member and pivoting of the top drive unit about the top drive pivot axis.

The slidable storage carrier allows various pieces of drilling equipment, e.g. other than drilling tubulars, e.g. drill bits, reamers, etc., to be stored and moved to a position where the top drive unit may engage the stored equipment. The top drive unit may be pivoted to a storage position thereof, distinct from the drilling position and the transfer position thereof, to receive a piece of equipment from the slidable storage, e.g. by connecting said equipment to the lower end of a drilling tubular suspended from the top drive. This allows for efficient storage of equipment.

In embodiments, the drill floor further comprises one or more mouseholes, e.g. provided on the imaginary circle, for storing therein drilling equipment, e.g. pub joints. The top drive unit may engage drilling equipment stored in the mouseholes by pivoting the top drive unit to a suitable location and moving the top drive unit towards the drill floor. This allows for an alternative or additional means to store drilling equipment compared to the slidable storage carrier.

In embodiments, the loader further comprises a pipe end stop for axially positioning of a drilling tubular gripped by the loader. The pipe end stop allows drilling tubulars to be axially positioned in the loader, e.g. when moving between the receiving position and the hand off position. This allows the height of the top end of the tubular gripped by the loader to be controlled. In embodiments, the position of the pipe end stop on the loader boom, e.g. relative to the gripper, may be controlled, e.g. in order to accommodate for drilling tubulars for various lengths.

In embodiments, the top drive system further comprises a mudline swivel allowing to circulate drilling mud or other fluids through the drill string.

In embodiments, the road vehicle is provided with one or more stabilizers, e.g, wherein at least one of the stabilizers is provided at the rear of the chassis, wherein the stabilizer is configured to support the rear end of the chassis in the working position of the drilling tower, wherein the stabilizer is slideable connected to the chassis such that the chassis, while supported in the working position, can be moved relative to the stabilizer. The stabilizer provides a stable mobile land rig. In embodiments the stabilizer further allows to adjust the position of the mobile land rig, e.g. of the drilling line thereof, relative to the wellbore.

In embodiments, the mobile land rig further comprises a tower actuator, e.g. a hydraulic cylinder, for moving the drilling tower between the working position and the transport position and/or comprises a boom actuator, e.g. a hydraulic cylinder, for moving the loader between the receiving position and the hand off position.

The invention is further related to a method for performing drilling and/or other wellbore related activities wherein use is made of a land rig according to the invention.

In embodiments of the method, the method comprises:

- pivoting the drilling tower to the working position;
- pivoting the loader to the receiving position;
- receiving, by the gripper, a drilling tubular;
- pivoting the loader, while gripping the drilling tubular from the receiving position to the hand off position;
- pivoting the top drive unit to the transfer position;
- engaging the top drive unit to the drilling tubular gripped by the gripper;
- releasing the drilling tubular from the gripper; and
- pivoting the top drive unit and the drilling tubular from the transfer position to the drilling position.

In this embodiment the mobile land rig is used to perform wellbore drilling activities wherein a tubular is transported from a tubular storage to the drilling line.

In embodiments of the method, the method comprises:

- pivoting the drilling tower to the working position;
- pivoting the loader to the hand off position;
- engaging, by the top drive unit in the drilling position, a drilling tubular in the drilling line;
- pivoting the top drive unit and the drilling tubular, from the drilling position to the transfer position;
- gripping, by the gripper, the drilling tubular engaged by the top drive unit;
- disengaging the drilling tubular from the top drive unit;
- pivoting the loader from the transfer position to the receiving position; and
- removing the drilling tubular from the loader, e.g. to a drilling tubular storage.

In this embodiment the mobile land rig is used to perform wellbore drilling activities wherein a tubular is transported from the drilling line to a tubular storage.

A second aspect of the invention relates to a gripper as described herein supported by or configured to be supported by the loader boom of a loader of a mobile land rig for performing of wellbore drilling and/or other wellbore related activities.

The second aspect of the invention, for example, relates to a gripper, e.g. supported by or configured to be supported by the loader boom of a loader of a mobile land rig, for wellbore drilling and/or other wellbore related activities, which gripper comprises:

- a main shaft provided with at least one jaw set, e.g. two spaced apart jaw sets, wherein the jaw set comprises:
  - a first jaw pivotally mounted via a jaw base thereof on the main shaft;
  - a second jaw pivotally mounted via a jaw base thereof on the main shaft adjacent to the first jaw;

a jaw set actuator mechanism that is adapted to cause synchronized pivotal motion in opposed pivotal directions of the first and second jaws about the main shaft;

which jaw set actuator mechanism comprises a gear wheel that is provided on a gear wheel axle which is mounted radially to the main shaft, which gear wheel meshes with a toothing that is provided on the first jaw base and with a toothing that is provided on the second jaw base, providing synchronized pivotal motion of the first jaw and the second jaw, and wherein the jaw set actuator mechanism comprises a jaws actuator that is provided between the first jaw and the second jaw and connected to the first jaw at a point away from the jaw base of the first jaw and to the second jaw at a point away from the jaw base of the second jaw, so as to be able to exert a relative pulling or pushing force between the first jaw and the second jaw.

For example, the main shaft is a hollow steel tube.

In embodiments, of the second aspect the jaw set further comprises:

a third jaw pivotally mounted via a jaw base thereof on the main shaft adjacent to the second jaw and opposite to the first jaw;

a second jaws actuator provided between the second jaw and the third jaw and connected to the second jaw at a point away from the jaw base of the second jaw and to the third jaw at a point away from the jaw base of the third jaw, so as to be able to exert a relative pulling or pushing force between the second jaw and the third jaw.

The second aspect of the invention, for example, relates to a gripper, e.g. supported by or configured to be supported by the loader boom of a loader of a mobile land rig, for wellbore drilling and/or other wellbore related activities, which gripper comprises:

a main shaft provided with at least one jaw set, e.g. two spaced apart jaw sets, wherein the main shaft is journaled about a main axis thereof about a gripper base that is mounted to the loader boom to allow for pivoting of the gripper, wherein an actuator is provided for rotating the main shaft about the main axis, wherein, e.g., the main shaft is rotatable to bring the at least one jaw set into a horizontal transfer position that allows for horizontal transfer of a drilling tubular between a tubulars storage wherein drilling tubulars are stored and the jaw set when the loader boom is in the receiving position, e.g. into two opposed positions allowing for horizontal transfer into two opposite horizontal directions when the loader boom is in the receiving position, e.g. for transfer out of and to a tubulars storage on a further road vehicle parked adjacent the chassis on which the loader boom is mounted.

As discussed herein, measures of the second aspect of the invention may be applied in combination. For example, as discussed herein the gripper may be combined with a loader as discussed herein and/or a land rig as discussed herein.

The invention will now be described with reference to the appended drawings.

Figure 2A:
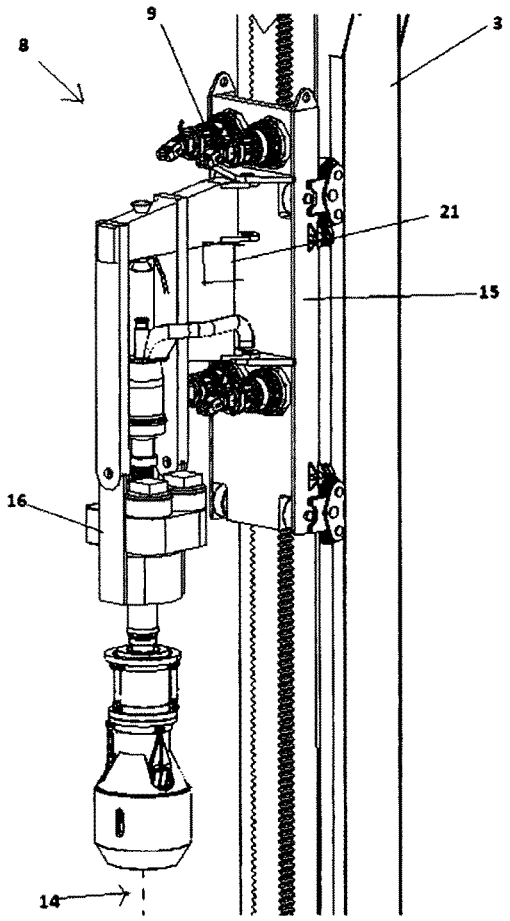
Figure 2B:
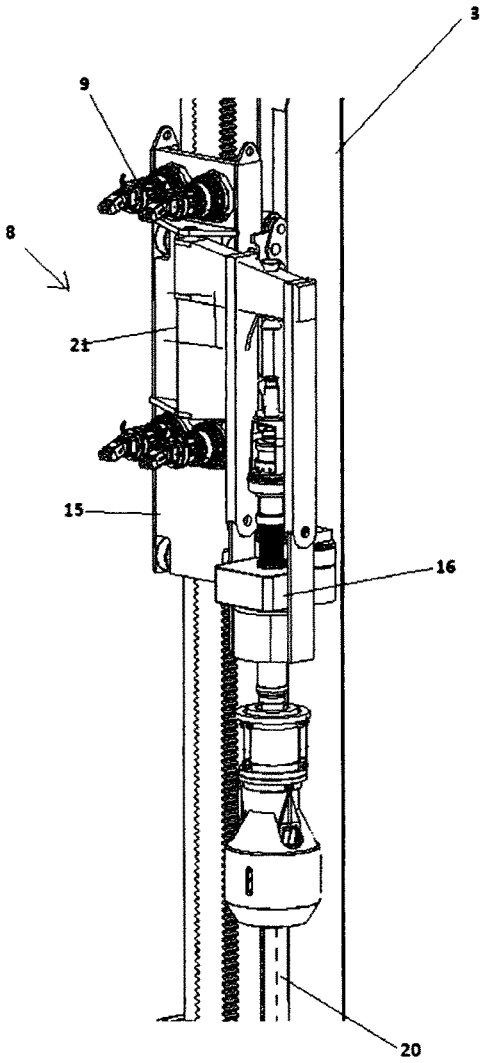
Figure 3A:
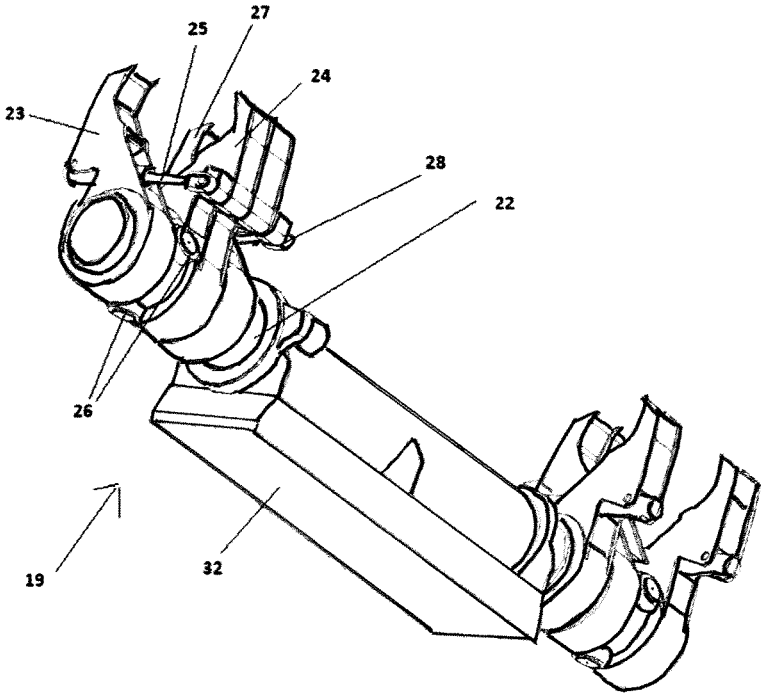
Figure 3B:
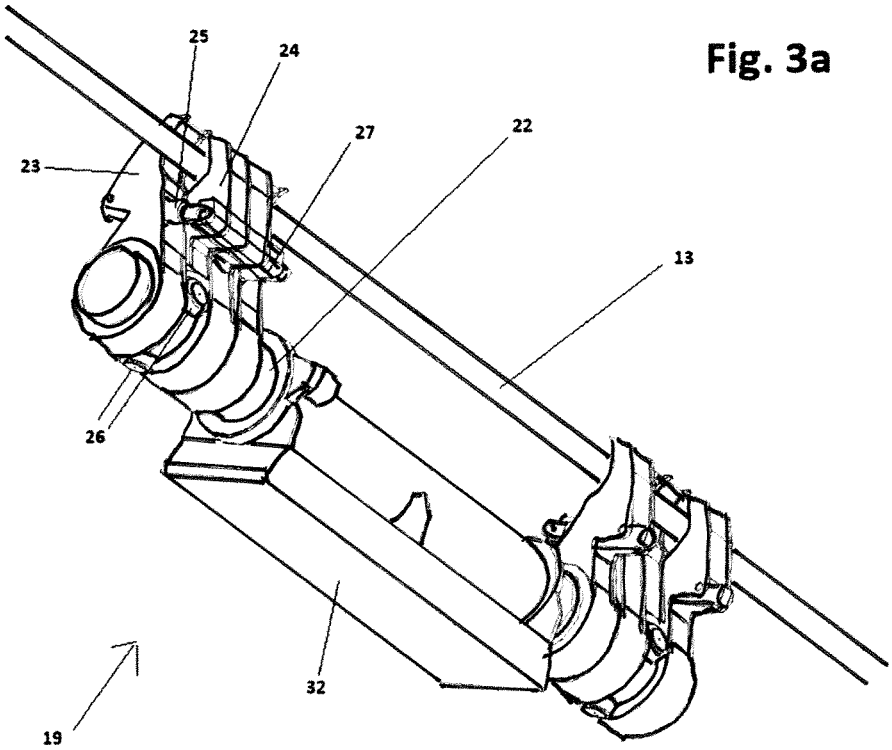
Figure 4A:
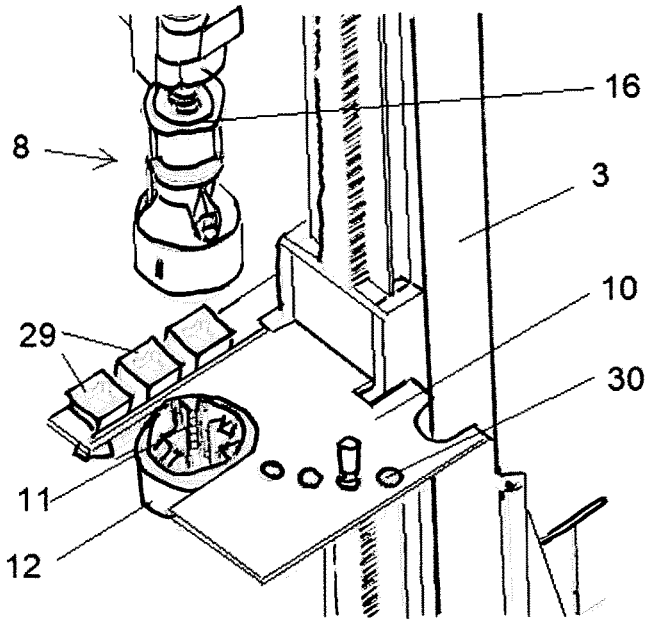
Figure 5:
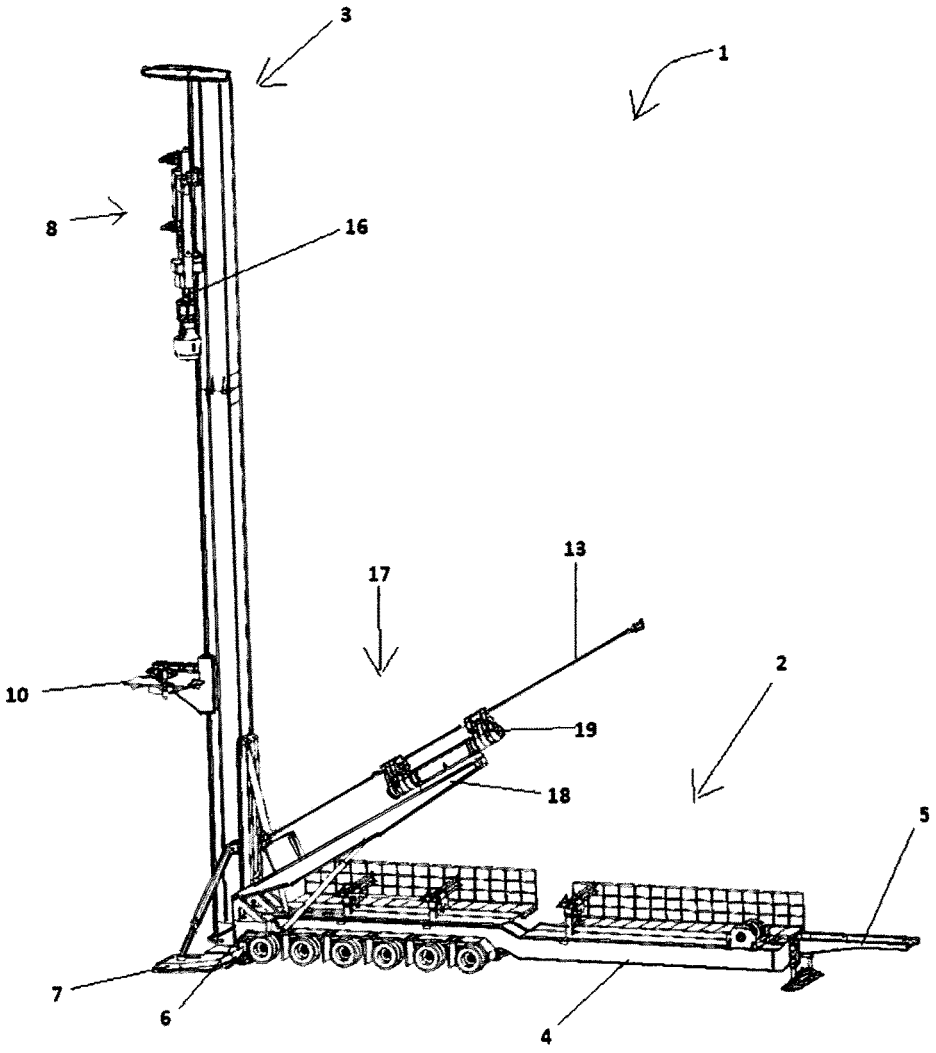

In the drawings:

FIG. 1 shows the mobile land rig;

FIG. 2*a* shows the top drive unit in the drilling position;

FIG. 2*b* shows the top drive unit in the transfer position;

FIG. 3*a* shows the gripper in an opened configuration;

FIG. 3*b* shows the gripper gripping a tubular;

FIGS. 4*a, b, c* show the top drive unit in different positions relative to the drill floor; and FIG. 5 shows the mobile land rig.

FIG. 1 shows the mobile land 1 wherein the drilling tower 3 is in the working position and the loader 17 is in the hand off position. The mobile land rig 1 comprises a road vehicle, a trailer 4 in this figure, having a chassis 4 with a front end 5 and a rear end 6. The chassis 4 of the road vehicle is an elongated chassis 4. In this figure, stabilizers 7 are provided near the rear end 6 of the chassis to support the chassis 4 when the drilling tower 3 is in the working position, as depicted. In embodiments, the stabilizers 7 are slidable connected to the chassis 4 to allow movement of the mobile land rig 1 relative to the wellbore, e.g. to slightly adjust the position of the mobile land rig 1 relative to the wellbore.

The drilling tower 3 is provided at the rear end 6 of the chassis 4 and is pivotally, e.g. by a hydraulic cylinder, relative to the road vehicle 2 around a tower pivot axis between a transport position and the working position. The tower pivot axis extends transverse to the longitudinal axis, such that the tower is pivotally between a substantially horizontal position, the transport position, and a substantially vertical position, the working position. In the transport position, not depicted, the drilling tower 3 is parallel along its longitudinal axis with the longitudinal axis of the road vehicle 2 and lies thereon. This allows transport of the drilling tower 3 by the road vehicle 2.

The mobile land rig 1 further comprises a top drive system 8 supported by the drilling tower 3, a motion drive 9, adapted to cause motion of the top drive system 8 parallel to the longitudinal axis of the drilling tower 1 in order to perform drilling and tripping operations. In this figure the motion drive 9 is a rack and pinion drive 9 which allows precise movement of the top drive system 8 along the drilling tower 3.

The top drive system 8 comprises a traveling carriage 15 which is vertically mobile along the drilling tower 3 when in the working position by means of the rack and pinion drive 9. The carriage 15 supports a top drive unit 16 comprising a top drive motor and a rotary torque output member adapted to be engaged with a top end of a drilling tubular 13.

The top drive unit 16 is pivotally supported by the traveling carriage 15 around a top drive pivot axis which extends parallel to the longitudinal axis of the drilling tower 3. The top drive unit 16 may be pivoted between a transfer position and a drilling position, when the drilling tower 3 is in the working position. The top drive system 82 is provided with an actuator assembly 21 adapted to cause said pivot motion of the top drive unit 16. In this figure the top drive unit 16 is pivoted away from the drilling line 14 and suspended in the transfer position above the pipe receiving line 20.

The mobile land rig 1 further comprises a drill floor 10 supported by the drilling tower with a well center 11 positionable above a wellbore. A slip device 12 adapted to suspend a drilling tubulars string in the wellbore is supported by the drill floor 10 and centered around the well center 11. As may be seen in this figure, the drill floor 10 is supported by the rack of the motion drive 9 allowing vertical motion of the drill floor 10. This allows repositioning of the drill floor 10 relative to the drilling tower 10 and the wellbore. The drill floor 10 further comprises a slidable storage carrier 29 and mouse holes 30 for storing drilling equipment, better seen in FIGS. 4*a*, 4*b* and 4*c*.

The drilling line 14 extends through the well center 11 parallel to the longitudinal axis of the drilling tower 3. In operations a drilling tubulars string may extend along the drilling line, e.g. from the slip device 12 into the wellbore.

The mobile land rig 1 further comprises a loader 17 comprising a pivotally loader boom 18 and a gripper 19 for gripping drilling tubulars 13. The gripper 19 is supported by the loader boom 19. The loader boom 18 is pivotally, e.g. by a hydraulic cylinder, around a loader pivot axis between a tubular receiving position and a tubular hand off position. The loader pivot axis extends parallel to the tower pivot axis. In FIG. 1 the loader 17 is in the hand off position wherein the loader boom 18 extends in a vertical direction transverse to the longitudinal axis of the chassis 4.

The loader 17 is adapted to grip and move a drilling tubular 13 as the loader boom 18 pivots between the receiving position and the hand off position. This allows the loader 17 to erect drilling tubulars 13. In embodiments drilling tubulars 13 are provided by a separate road vehicle in a substantially horizontal position. These drilling tubulars 13 are then provided to the loader 17 and gripped by the gripper 19, before being erected to a vertical position by the loader 17. In the vertical position the drilling tubular 17 aligns with the pipe receiving line 20 as depicted in FIG. 1.

When the drilling tower 3 is in the working position and the loader boom 17 is in the hand off position, as depicted, the top drive pivot axis defines a center of an imaginary circle comprising the drilling line 14 and the pipe receiving line 20. This allows the top drive unit 16 to make a circular motion as it pivots between a position aligned with the drilling line 14, drilling position, and a position aligned with the pipe receiving line 20, transfer position.

In the drilling position, the rotary torque output member is adapted to be engaged with a top end of a drilling tubulars string extending in the drilling line 14 through the well center 11 to impart torque to the drilling tubulars string in order to perform drilling or other wellbore related activities. Whereas in the transfer position, the rotary torque output member is adapted to be engaged with a top end of a drilling tubular 13 gripped by the gripper so as to move the drilling tubular between the pipe receiving line 20 and the drilling line 14.

As can be seen in the figure the top drive unit 16 is suspended some distance above the drilling tubular 13 suspended by the loader 17. By moving the top drive system 8 downwards by the motion drive 9, the top drive unit 16 may engage the drilling tubular 13.

As is understood order and direction of movement of the various components of the land rig 1 depend on the drilling activity performed. For example during wellbore drilling tubulars are provided by the loader 17 into the pipe receiving line 20 to be engaged by the top drive unit 16, while the drilling tubulars string is suspended by the slip device 12. Whereas during removal of the drilling tubulars string from the wellbore, the top drive system 8 transports drilling tubulars 13 from the drilling line 14 towards the pipe receiving line 20 to be gripped by the gripper 19 and removed by the loader 19.

FIGS. 2*a* and 2*b* show a close up of the top drive system 8, wherein the top drive unit 16 is in the drilling position, FIG. 2*a*, and in the transfer position, FIG. 2*b*. The top drive system 8 as shown in the figures comprises a traveling carriage 15 which is mobile along the drilling tower 3. The vertical motion drive 9 is embodied as a rack and pinion drive wherein the rack is provided on the drilling tower 3.

The actuator assembly 21 for allowing pivoting of the top drive unit 16 is shown schematically in the figures. By actuating the actuator assembly 21 the top drive unit 16 may be pivoted around a vertical pivot axis which results in the top drive unit 16 to change position relative to the traveling carriage 15 and the drilling tower 3. In particular the top drive unit 16 may be pivoted towards a drilling position aligned with the drilling line 14, as shown in FIG. 2*a*, or towards a transfer position aligned with the drilling line 20, as shown in FIG. 2*b*. The top drive unit 16 may be pivoted towards other positions as shown herein, e.g. aligned with a mouse hole 30 or a slidable storage carrier 29.

The actuator assembly 21 may be a hydraulic actuator assembly 21, e.g. a hydraulic cylinder. In other embodiments, the actuator assembly 21 may be a mechanic assembly, e.g. comprising a geared mechanism for pivoting the top drive unit 16.

In the embodiments shown herein the loader 17 is to the right of the drilling tower 3 as seen from the rear of the road vehicle 2. In other embodiments the loader 17 may be to the left of the drilling tower 3 as seen from the rear of the road vehicle 2. In these embodiments the top drive unit 16 pivots in an opposite direction from the drilling line 13 to the pipe receiving line 20.

FIGS. 3*a* and 3*b* show a close up of the gripper 19 in an opened configuration, FIG. 3*a*, and a closed configuration, FIG. 3*b*. The gripper 19 comprises a main shaft 22 provided with two jaw sets that are spaced apart. The jaw sets are provided at opposite ends of the main shaft 22.

Each jaw set comprises a first jaw 23 mounted via a jaw base thereof on the main shaft 22, a second jaw 24 mounted via a jaw base thereof on the main shaft 22, and a third jaw 27 mounted via a jaw base thereof on the main shaft 22. The jaw set further comprises a jaw set actuator mechanism that is adapted to cause synchronized pivotal motion in opposed pivotal directions of the first 23, second 24 and third 27 jaws about the main shaft 22.

The jaw set actuator mechanism comprises gear wheels 26 and a first and second jaws actuator 25. The gear wheels 26 are provided on a gear wheel axle which is mounted radially to the main shaft 22. The gear wheels 6 mesh with a toothing that is provided on the first jaw base and with a toothing that is provided on the second jaw base, providing synchronized pivotal motion of the first jaw 23 and the second jaw 24. The third jaw 27 motion may be controlled relative to the motion of the first 23 and second 24 jaw, because the third jaw is rigidly fixed to the first jaw 22.

The jaws actuator comprises a hydraulic cylinder 25, that is provided between the first jaw 23 and the second jaw 24 and connected to the first jaw 23 at a point away from the jaw base of the first jaw 23 and to the second jaw 24 at a point away from the jaw base of the second jaw 24, and a second hydraulic cylinder 28, that is provided between the second jaw 24 and the third jaw 27 and connected to the second jaw 24 at a point away from the jaw base of the second jaw 24 and to the third jaw 27 at a point away from the jaw base of the third jaw 27.

The main shaft 22 is journaled about a main axis thereof about a gripper base 32. The gripper base 32 of the mobile land rig 1 is mounted to the loader boom 18 to allow for pivoting of the gripper 19, wherein an actuator is provided for rotating the main shaft 22 about the main axis.

For example, this allows to bring the at least one jaw set into a horizontal transfer position that allows for horizontal transfer of a drilling tubular 13 between a tubulars storage wherein drilling tubulars 13 are stored and the jaw set when the loader boom 18 is in the receiving position. It may also allow the gripper 19 to be rotated into two opposed positions allowing for horizontal transfer into two opposite horizontal directions when the loader boom 18 is in the receiving position, e.g. for transfer out of and to a tubulars storage on a further road vehicle parked adjacent the chassis 4 on which the loader boom 18 is mounted.

FIGS. 4*a, b, c* show the top drive unit 16 in different positions relative to the drill floor 10. FIG. 4*a* shows the top drive unit 16, as part of the top drive system 8, in a raised drilling position above the wellbore center 11 and the slip device 12. In this position the top drive unit 16 is aligned with the drilling line 14 and may be engaged to a drilling tubulars string in the wellbore.

Figure 4B:
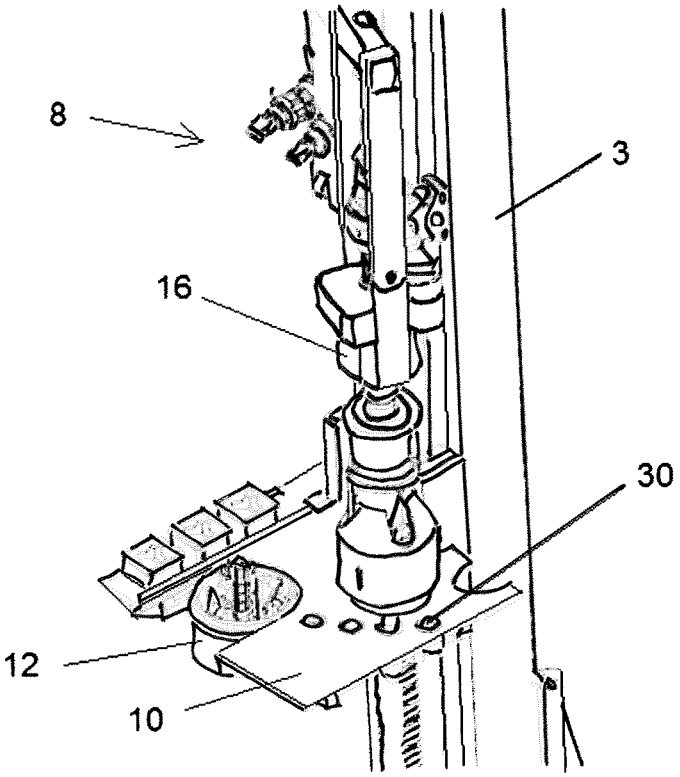

FIG. 4*b* shows the top drive unit 16 in a position above a mouse hole 30, wherein a piece of drilling equipment is stored. The top drive system 8 is lowered to allow engagement of the top drive unit 16 with the stored piece of equipment. Subsequently the top drive system 8 may be raised by the motion drive 9 to raise the equipment from the mouse hole 30 and allow pivoting of the top drive unit 16, e.g. towards the drilling line.

Figure 4C:
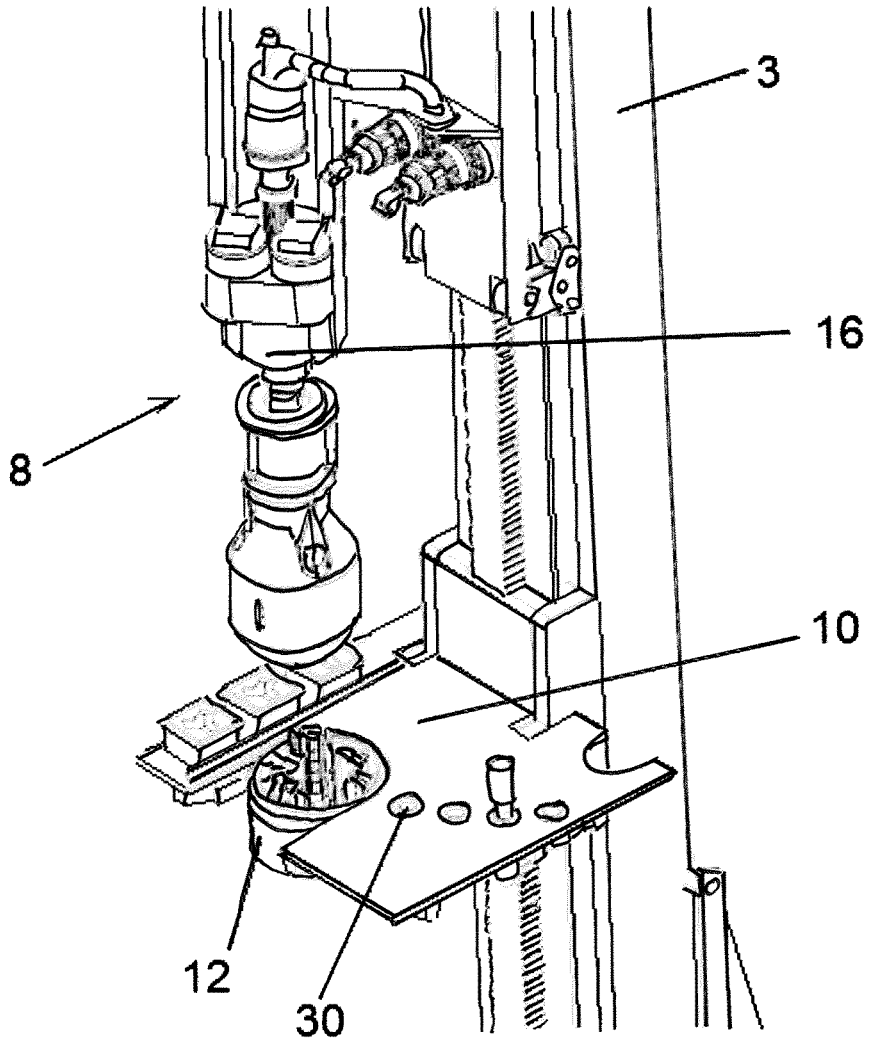

FIG. 4*c* shows the top drive unit 16 in a lowered position above the slidable storage carrier 29. The top drive unit 16 may engage a piece of equipment stored in the slidable storage carrier 29 or disengage a piece of equipment to be stored in the slidable storage carrier 29. The slidable storage carrier is slidable in a direction transverse to the drilling tower 3 to allow different storage positions to be reachable by the top drive unit 16.

FIG. 5 shows the mobile land rig 1 wherein the loader 17 is in a position between the hand off position and the receiving position while gripping a tubular 13. The road vehicle 2 is embodied as a trailer 2 having a front end 5 and a rear 6. Both the drilling tower 3 and the loader 17 are provided at the rear end of the chassis 4. The drilling tower 3 is in the working position and the top drive unit 16 is provided in the transfer position, e.g. awaiting the loader 17 to reach the hand off position to transfer the tubular 13 from the loader to the top drive unit 16.

The invention claimed is:

1. A mobile land rig adapted to perform drilling and/or other wellbore related activities, the mobile land rig comprising:

an elongated chassis, the chassis having a longitudinal axis extending between a front end and a rear end;

a drilling tower pivotally connected to the chassis about a tower pivot axis between a transport position for transporting the mobile land rig and a working position, wherein the tower pivot axis extends transverse to the longitudinal axis of the chassis, wherein, in the transport position, the drilling tower lies on the chassis, and wherein, in the working position, the drilling tower extends vertically;

a top drive system comprising:

a traveling carriage vertically mobile along the drilling tower in the working position thereof by means of a vertical motion drive; and a top drive unit supported by the traveling carriage and comprising a top drive motor and a rotary torque output member adapted to be engaged with a top end of a drilling tubular;

a vertical motion drive adapted to cause said motion of the traveling carriage of the top drive system along the drilling tower in order to perform drilling and/or other wellbore related activities;

a drill floor supported by the drilling tower, the drill floor being provided at a well center thereof with a slip device adapted to suspend a drilling tubulars string in a wellbore, wherein a drilling line extends through the well center when the drilling tower is in the working position; and a drilling tubulars handling device adapted to provide and remove a drilling tubular to and from a pipe receiving line relative to the drilling mast, wherein the top drive unit is pivotally supported on the traveling carriage about a top drive pivot axis, which extends parallel to the longitudinal axis of the drilling tower, between a transfer position and a drilling position, wherein the top drive system is provided with an actuator assembly adapted to cause said pivot motion of the top drive unit, wherein, when the drilling tower is in the working position and the top drive unit is in the drilling position, the top drive unit is aligned with the drilling line, and the rotary torque output member is adapted to, when engaged with a top end of a drilling tubulars string extending in the drilling line through the well center, impart torque to the drilling tubulars string in order to perform drilling and/or other wellbore related activities, wherein, when the drilling tower is in the working position and the top drive unit is in the transfer position, the top drive unit is aligned with the pipe receiving line, and the top drive unit is adapted to be engaged with a top end of a drilling tubular in the pipe receiving line so as to transfer the drilling tubular from the pipe receiving line to the drilling line, wherein the drilling tubulars handling device is mounted on the chassis, wherein the drilling tubulars handling device comprises a loader comprising:

a pivotal loader boom; and a gripper for gripping a drilling tubular extending in a gripping line, which gripper is supported by the loader boom, wherein the loader boom is pivotally connected to the chassis about a loader pivot axis between a tubular receiving position and a vertical tubular hand off position, wherein the loader pivot axis is transverse to the longitudinal axis of the chassis, wherein the loader is adapted to grip and move a drilling tubular when the loader boom pivots between the receiving position and the hand off position, wherein the gripping line coincides with the pipe receiving line when the loader is in the hand off position, and wherein the gripper comprises:

a main shaft provided with a jaw set, wherein the jaw set comprises:

a first jaw pivotally mounted via a first jaw base thereof on the main shaft;

a second jaw pivotally mounted via a second jaw base thereof on the main shaft adjacent to the first jaw; and a jaw set actuator mechanism adapted to cause synchronized pivotal motion in opposed pivotal directions of the first and second jaws about the main shaft, wherein the jaw set actuator mechanism comprises a gear wheel provided on a gear wheel axle mounted radially to the main shaft, the gear wheel meshing with a toothing provided on the first jaw base and with a toothing provided on the second jaw base, providing synchronized pivotal motion of the first jaw and the second jaw, and wherein the jaw set actuator mechanism comprises a jaws actuator provided between the first jaw and the second jaw and connected to the first jaw at a point away from the first jaw base of the first jaw and to the second jaw at a point away from the second jaw base of the second jaw, so as to be able to exert a relative pulling or pushing force between the first jaw and the second jaw.

2. The mobile land rig according to claim 1, wherein each jaw set further comprises:

a third jaw pivotally mounted via a third jaw base thereof on the main shaft adjacent to the second jaw and opposite to the first jaw; and a second jaws actuator provided between the second jaw and the third jaw and connected to the second jaw at a point away from the second jaw base of the second jaw and to the third jaw at a point away from the third jaw base of the third jaw, so as to be able to exert a relative pulling or pushing force between the second jaw and the third jaw.

3. The mobile land rig according to claim 1, wherein the main shaft is journaled about a main axis thereof about a gripper base mounted to the loader boom to allow for pivoting of the gripper, wherein an actuator is provided for rotating the main shaft about the main axis.

4. The mobile land rig according to claim 3, wherein the main shaft is rotatable to bring the jaw sets into a horizontal transfer position that allows for horizontal transfer of a drilling tubular between a tubulars storage wherein drilling tubulars are stored and the jaw sets when the loader boom is in the receiving position.

5. The mobile land rig according to claim 1, wherein the main shaft is a hollow steel tube.

6. The mobile land rig according to claim 1, wherein the gripper has two spaced apart jaw sets for gripping a drilling tubular.

7. A mobile land rig adapted to perform drilling and/or other wellbore related activities, the mobile land rig comprising:

an elongated chassis, the chassis having a longitudinal axis extending between a front end and a rear end;

a drilling tower pivotally connected to the chassis about a tower pivot axis between a transport position for transporting the mobile land rig and a working position, wherein the tower pivot axis extends transverse to the longitudinal axis of the chassis, wherein, in the transport position, the drilling tower lies on the chassis, and wherein, in the working position, the drilling tower extends vertically;

a top drive system comprising:

a traveling carriage vertically mobile along the drilling tower in the working position thereof by means of a vertical motion drive; and a top drive unit supported by the traveling carriage and comprising a top drive motor and a rotary torque output member adapted to be engaged with a top end of a drilling tubular;

a vertical motion drive adapted to cause said motion of the traveling carriage of the top drive system along the drilling tower in order to perform drilling and/or other wellbore related activities; and a slip device arranged at a well center and adapted to suspend a drilling tubulars string in a wellbore, wherein a drilling line extends through the well center when the drilling tower is in the working position, wherein the mobile land rig further comprises a drilling tubulars handling device adapted to provide and remove a drilling tubular to and from a pipe receiving line relative to the drilling mast, wherein the drilling tubulars handling device comprises a loader comprising:

a pivotal loader boom; and a gripper for gripping a drilling tubular extending in a gripping line, the gripper being supported by the loader boom, wherein the loader boom is pivotally connected to the chassis about a loader pivot axis between a tubular receiving position and a vertical tubular hand off position, wherein the loader pivot axis is transverse to the longitudinal axis of the chassis, wherein the loader is adapted to grip and move a drilling tubular when the loader boom pivots between the receiving position and the hand off position, wherein the gripper comprises:

a main shaft provided with a jaw set, wherein the jaw set comprises:

a first jaw pivotally mounted via a first jaw base thereof on the main shaft;

a second jaw pivotally mounted via a second jaw base thereof on the main shaft adjacent to the first jaw; and a jaw set actuator mechanism adapted to cause synchronized pivotal motion in opposed pivotal directions of the first and second jaws about the main shaft, wherein the jaw set actuator mechanism comprises a gear wheel provided on a gear wheel axle mounted radially to the main shaft, the gear wheel meshing with a toothing provided on the first jaw base and with a toothing provided on the second jaw base, providing synchronized pivotal motion of the first jaw and the second jaw, and wherein the jaw set actuator mechanism comprises a jaws actuator provided between the first jaw and the second jaw and connected to the first jaw at a point away from the first jaw base of the first jaw and to the second jaw at a point away from the second jaw base of the second jaw, so as to be able to exert a relative pulling or pushing force between the first jaw and the second jaw.

8. The mobile land rig according to claim 7, wherein the jaw set further comprises:

a third jaw pivotally mounted via a third jaw base thereof on the main shaft adjacent to the second jaw and opposite to the first jaw; and a second jaws actuator provided between the second jaw and the third jaw and connected to the second jaw at a point away from the second jaw base of the second jaw and to the third jaw at a point away from the third jaw base of the third jaw, so as to be able to exert a relative pulling or pushing force between the second jaw and the third jaw.

9. The mobile land rig according to claim 7, wherein the main shaft is a hollow steel tube.

10. The mobile land rig according to claim 7, wherein the gripper has two spaced apart jaw sets for gripping a drilling tubular.

11. A mobile land rig for performing of wellbore drilling and/or other wellbore related activities, wherein the mobile land rig comprises a loader with a loader boom, the loader boom supporting a gripper for gripping a drilling tubular extending in a gripping line, the gripper comprising:

a main shaft provided with a jaw set, wherein the jaw set comprises:

a first jaw pivotally mounted via a first jaw base thereof on the main shaft;

a second jaw pivotally mounted via a second jaw base thereof on the main shaft adjacent to the first jaw; and a jaw set actuator mechanism adapted to cause synchronized pivotal motion in opposed pivotal directions of the first and second jaws about the main shaft;

wherein the jaw set actuator mechanism comprises a gear wheel provided on a gear wheel axle mounted radially to the main shaft, the gear wheel meshing with a toothing provided on the first jaw base and with a toothing provided on the second jaw base, providing synchronized pivotal motion of the first jaw and the second jaw, and wherein the jaw set actuator mechanism comprises a jaws actuator provided between the first jaw and the second jaw and connected to the first jaw at a point away from the first jaw base of the first jaw and to the second jaw at a point away from the second jaw base of the second jaw, so as to be able to exert a relative pulling or pushing force between the first jaw and the second jaw.

12. The mobile land rig according to claim 11, wherein the mobile land rig comprises:

an elongated chassis, the chassis having a longitudinal axis extending between a front end and a rear end;

a drilling tower pivotally connected to the chassis about a tower pivot axis between a transport position for transporting the mobile land rig and a working position, wherein the tower pivot axis extends transverse to the longitudinal axis of the chassis, and wherein, in the transport position, the drilling tower lies on the chassis, and wherein, in the working position, the drilling tower extends vertically;

a top drive system comprising:

a traveling carriage vertically mobile along the drilling tower in the working position thereof by means of a vertical motion drive; and a top drive unit supported by the traveling carriage and comprising a top drive motor and a rotary torque output member adapted to be engaged with a top end of a drilling tubular; and a vertical motion drive adapted to cause said motion of the traveling carriage of the top drive system along the drilling tower in order to perform drilling and/or other wellbore related activities, wherein the loader boom is pivotally connected to the chassis about a loader pivot axis between a tubular receiving position and a vertical tubular hand off position, wherein the loader pivot axis is transverse to the longitudinal axis of the chassis.

* * * * *